United States Patent [19]

Suvak et al.

[11] 4,232,603

[45] Nov. 11, 1980

[54] DAMPENING DEVICE FOR OFFSET PRINTING MACHINE

[75] Inventors: Fahrettin Suvak, New Hyde Park, N.Y.; Robert Snyder, Gilette, N.J.

[73] Assignee: Wood Industries, Inc., Middlesex, N.J.

[21] Appl. No.: 12,709

[22] Filed: Feb. 16, 1979

Related U.S. Application Data

[63] Continuation of Ser. No. 752,267, Dec. 14, 1976, abandoned, which is a continuation-in-part of Ser. No. 611,262, Sep. 8, 1975, abandoned, which is a continuation-in-part of Ser. No. 407,440, Oct. 18, 1973, abandoned.

[51] Int. Cl.[3] ..... B41F 7/26; B41F 7/30; B41L 25/06

[52] U.S. Cl. ..... 101/148; 101/366

[58] Field of Search ..... 101/147, 148, 350, 363, 101/366, 207, 208, 209, 210; 261/83, 90, 92; 239/219, 220, 222, 222.11, 222.17, 223, 224; 118/325, 300; 159/45 R, 11 R

[56] References Cited

U.S. PATENT DOCUMENTS

| | | | |
|---|---|---|---|
| 1,683,259 | 9/1928 | Perdue | 239/220 |
| 2,057,548 | 10/1936 | Wallach et al. | 118/DIG. 1 |
| 2,101,202 | 12/1937 | Stevens | 101/148 X |
| 2,196,412 | 4/1940 | Grembecki | 261/92 X |
| 2,299,026 | 10/1942 | Merrill | 118/325 X |
| 2,345,337 | 3/1944 | Gardner | 101/148 X |
| 2,389,730 | 11/1945 | Iler | 101/147 |
| 2,660,113 | 11/1953 | Gullixson et al. | 101/147 X |
| 2,775,195 | 12/1956 | Martin | 101/148 |
| 2,966,723 | 1/1961 | Swope | 101/148 X |
| 2,972,944 | 2/1961 | Dahlgren | 101/148 |
| 3,008,407 | 11/1961 | Roberts et al. | 118/300 X |
| 3,094,065 | 6/1963 | Roberts | 101/148 |
| 3,143,065 | 8/1964 | Warczak | 101/147 |
| 3,273,224 | 9/1966 | Spicer | 101/148 X |
| 3,326,122 | 6/1967 | Wildeman | 101/148 |
| 3,411,411 | 11/1968 | Hermach et al. | 101/148 |

FOREIGN PATENT DOCUMENTS

| | | | |
|---|---|---|---|
| 846402 | 6/1952 | Fed. Rep. of Germany | 101/148 |
| 929485 | 6/1955 | Fed. Rep. of Germany | 101/148 |
| 931229 | 8/1955 | Fed. Rep. of Germany | 101/148 |
| 7026346 | 7/1970 | Fed. Rep. of Germany | 101/148 |
| 52377 | 12/1966 | German Democratic Rep. | 101/366 |
| 47170 | 11/1939 | Netherlands | 239/220 |

*Primary Examiner*—J. Reed Fisher
*Attorney, Agent, or Firm*—Pennie & Edmonds

[57] ABSTRACT

A dampening device for an offset lithographic printing machine of the type having a pickup roll having radially spaced fluid retaining means thereon rotatable in a bath of a dampening fluid where the fluid is transferred from the pickup roll to any one of a transfer roll, drum or form roll which together comprise part of a fluid distribution system radially spaced from the pickup roll for subsequent movement to a printing plate on a plate cylinder. The dampening device includes a gaseous blow means for directing a current of gas towards the pickup roll near the gap between the pickup roll and transfer roll, drum or form roll whereby fluid is blown from the fluid retaining means onto the surface of the pickup roll from where it rebounds across the gap to impinge on the transfer roll, drum or form roll as a finely dispersed spray.

The fluid retaining means comprises bristles, screen material or individual closed loops which carry droplets or a thin film of fluid when the pickup roll is rotated in a bath of dampening fluid.

9 Claims, 9 Drawing Figures

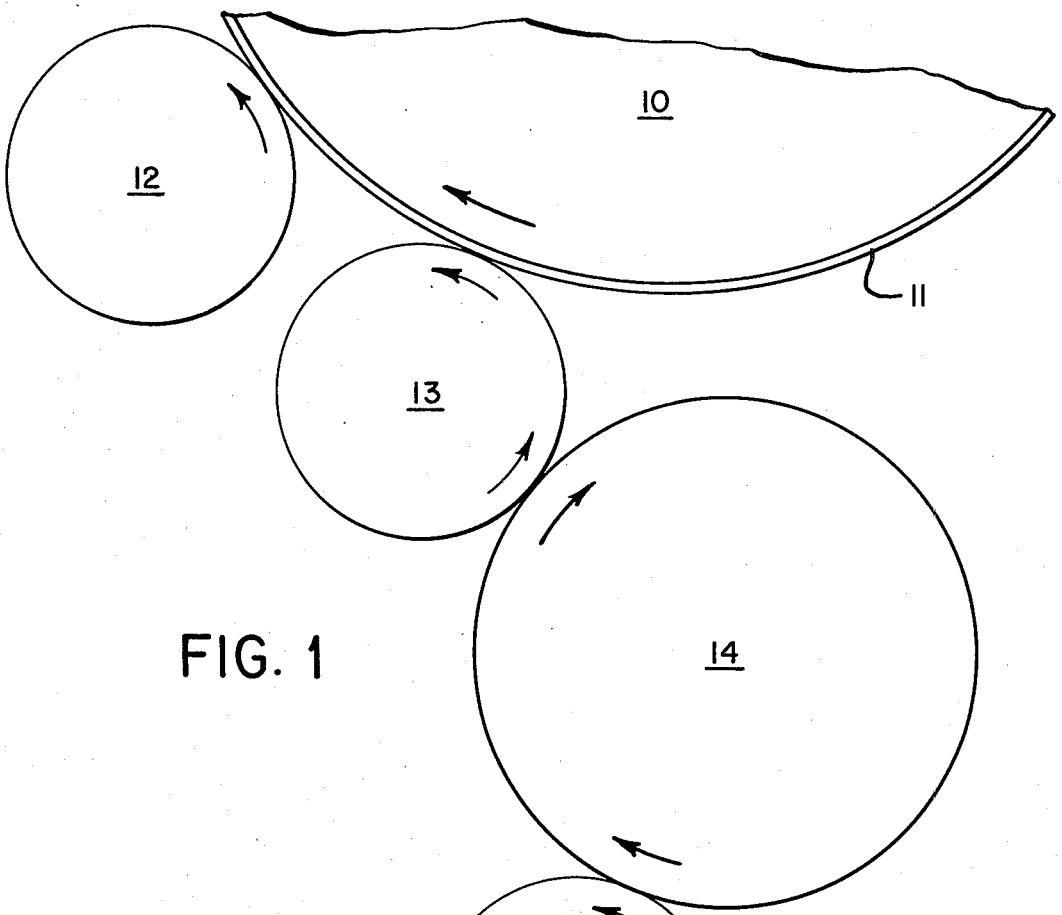
FIG. 1
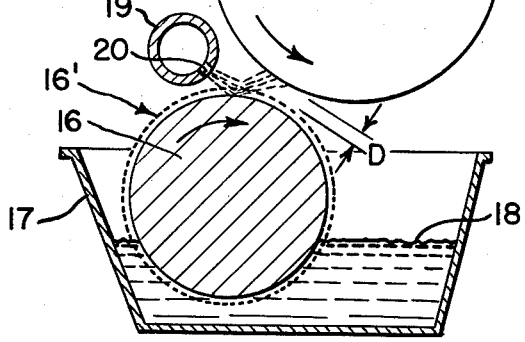
FIG. 2
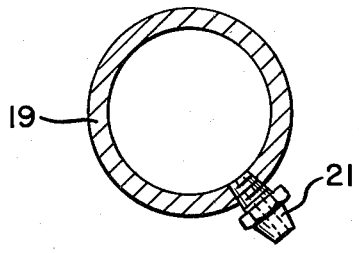

DAMPENING DEVICE FOR OFFSET PRINTING MACHINE

CROSS REFERENCE TO OTHER APPLICATIONS

This application is a continuation of our pending application Ser. No. 752,267 filed Dec. 14, 1976, now abandoned, which in turn is a continuation-in-part of our copending application Ser. No. 611,262 filed Sept. 8, 1975, now abandoned, which in turn is a continuation-in-part of our application Ser. No. 407,440 filed Oct. 18, 1973, now abandoned.

BACKGROUND OF THE INVENTION

The invention relates to a dampening device for offset lithographic printing machines and in particular to a device by which a dampening fluid is atomized and applied as a finely dispersed spray or mist to a transfer-roll, drum or form roll comprising part of a fluid distributing means for subsequent movement to a plate cylinder.

Various dampening devices for lithographic and offset printing machines have been used in the past. In all such devices, there is the requirement that the dampening fluid, which may take the form of water, be evenly spread and finely distributed in the form of a fine film onto a lithographic stone or offset lithographic printing plate. Various devices have been used in the past in an attempt to insure that the dampening fluid film applied to the surface of the printing plate was even and of the same distribution across the width of the plate. Such devices have utilized spray guns, electrostatic charging of moving droplets of dampening fluid, or rotating brush rollers where the fibers of the brush are flicked to throw droplets of fluid onto a transfer roll. The prior art devices have not been completely successful in that the application of the fluid to the plate and the proper proportion of the fluid to the printing ink has often been affected by different speeds of the printing machine. Further, the prior art devices often caused ink streaking due to the inability to break the water up into sufficiently small droplets or mist such that it could be applied evenly onto the printing plate. It is therefore an object of our invention to provide for a dampening device which may provide an evenly distributed and consistent amount of dampening fluid to a printing plate cylinder notwithstanding the speed at which the press may operate.

GENERAL SUMMARY OF THE INVENTION

Broadly, dampening devices constructed according to our invention comprises having a pickup roll extend into a bath of a dampening fluid. The pickup roll has fluid retaining means radially spaced from the surface thereof comprising closed loops, screens or bristles by which a thin film of fluid may be carried. The pickup roll is separated by a small gap from at least one transfer roll, drum or form roll which together form a train of rotatable members and comprise a fluid distribution means. The device includes a gaseous blow means for blowing a current of gas, for example air, towards the peripheral surface of the pickup roll near the gap between the pickup roll and the fluid distribution means such that the thin film or droplets of fluid will be atomized and blown from the fluid retaining means onto other portions of the pickup roll where it rebounds across the gap to impinge upon the fluid distribution means as an evenly dispersed highly atomized spray. The fluid distribution means then transfers the fluid thereon to a printing plate on a plate cylinder.

The use of closed loops, screening or bristles, all of which include thread-like portions, insures that the film or droplets of fluid picked up on the surface of the pickup roll will be thin and easily atomized by the gaseous current. The amount of fluid to be transferred may be easily regulated by regulating the speed of rotation of the pickup roll or varying the force of the gaseous current. Thus if a greater amount of fluid is desired to be transferred to the printing plate, the pickup roll will be rotated faster thus picking up a greater amount of fluid in a given period of time or the pressure of gas providing the gaseous current may be increased.

DESCRIPTION OF THE DRAWINGS

FIG. 1 is a diagrammatical sectional view of a dampening device constructed according to the invention utilizing a fluid distribution means comprising a transfer roll, drum and form roll to dampen a plate cylinder, a portion of which is shown;

FIG. 2 is an enlarged sectional view of a modified form of gaseous blow means as used in FIG. 1;

DETAILED DESCRIPTION OF THE PREFERRED EMBODIMENTS

Figure 3:
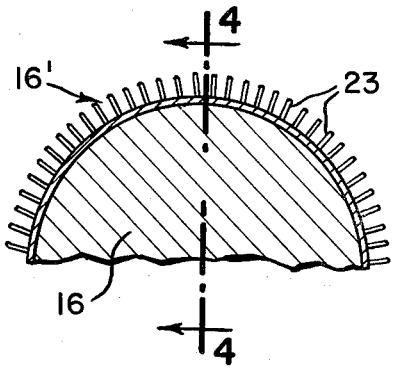
FIG. 3 is an enlarged view of a portion of a pickup roll of the type adapted to be used in FIG. 1 having one form of fluid retaining means thereon.

Referring to FIG. 1, there is illustrated a plate cylinder 10 having thereon a printing plate 11 which is contacted by an ink form roll 12. The plate 11 is also contacted by a dampening form roll 13 to which a dampening fluid is applied via drum 14 and further transfer roll 15. The form roll, drum and transfer roll together form a fluid distribution means which is part of a fluid distribution system. As shown, a dampening fluid pickup roll 16 is rotatable in a dampening fluid fountain 17 containing a bath of dampening fluid 18.

A gaseous blow means comprising a duct 19 having a plurality of orifices 20 therein is positioned to extend longitudinally and parallel with the pickup roll 16 such that a current of gas, preferably air, is blown towards the peripheral surface of roll 16 near a gap or space D between roll 16 and roll 15. As shown, fluid which is retained on the surface of the roll 16 by a fluid retaining means 16' as it rotates in the bath is blown from the retaining means 16' such that it contacts other portions of the pickup roll from where it rebounds to impinge onto the surface of the roll 15. The fluid is then transferred by the drum 14 to the roll 13 and subsequently to the surface of the printing plate 11.

As shown in FIG. 2, the gaseous blow means may be modified such that the conduit 19 may contain nozzles 21 through which air may be directed rather than an orifice 20. The use of nozzles provides more accurate control over the direction of the blown gas. Preferably the nozzle openings have a fan or elliptical-shaped cross-section, the major axis of which is parallel to the longitudinal axis of the transfer roll. This constructionassists in assuring even concentration of the spray pattern on the transfer roll in the longitudinal direction.

Figure 4:
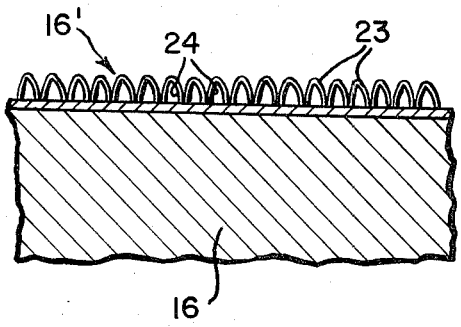
FIG. 4 is a sectional view of FIG. 3 taken along lines 4—4.

As shown in FIGS. 3 and 4, a fluid retaining means 16' comprises closed loops 23 which may hold a thin film of fluid in their openings 24. Preferably the closed loops comprise a material marketed under the registered trademark VELCRO made by the Velcro Corporation, 681 Fifth Avenue, New York, New York. The loops are generally formed of a sheet of woven fabric where the closed loops comprise threads of a synthetic material, such as nylon, which may be thermally treated to become semi-rigid.

As the roll 16 is rotated in the bath, the closed loops 23 will pick up a thin film of fluid in their openings 24 which as the roll rotates past the conduit 19, will be subjected to a current of gas. The thin film in the loop openings will be broken up and atomized and thrown onto the peripheral surface of the roll 16 where the atomized droplets will rebound to pass through the loop openings again being further atomized in the process to thus cross the gap D to impinge onto the surface of the roll 15. This will result in a finely dispersable layer of fluid particles being evenly distributed onto the surface of the roll 15.

It has also been found that the individual loops of the material shown in FIG. 3 may be cut so as to form a bristle-like material. Such bristles will also pick up and retain a thin film of fluid which may be broken up in the same manner by the gaseous current as shown in the embodiment of FIG. 3.

Figure 5:
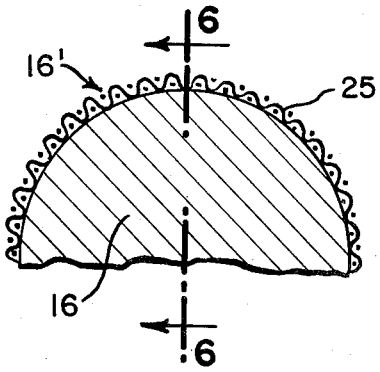
FIG. 5 is a view similar to FIG. 3 illustrating a further embodiment of a fluid retaining means on a pickup roll.
Figure 6:
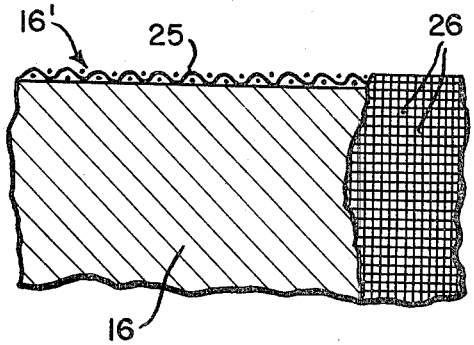
FIG. 6 is a sectional view of FIG. 5 taken along lines 6—6.

A still further form of fluid retaining means is disclosed in FIGS. 5 and 6 where the fluid retaining means comprises a fine mesh screen material 25 having openings 26 therein. The screen picks up thin films of fluid in openings of the wiring after which the films may be easily broken up and atomized by the gaseous current to impinge on the surface of the roll 16 where it then rebounds through the screen material to be further atomized to form a fine mist.

Figure 7:
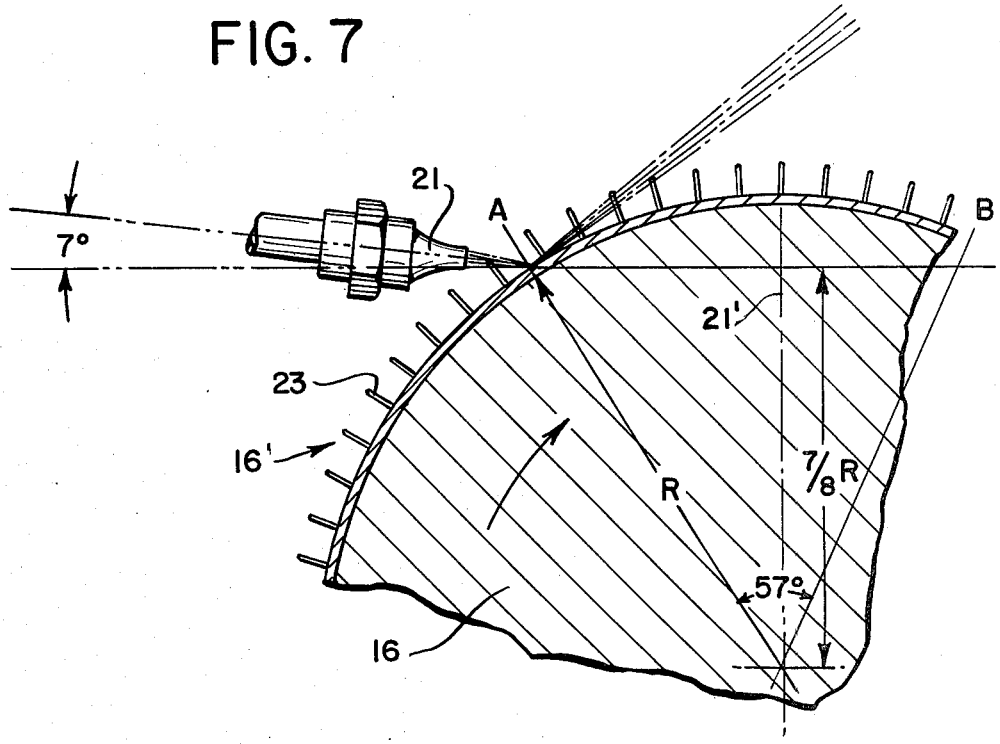
FIG. 7 is an enlarged view of a portion of FIG. 1 illustrating the spray pattern resulting from the gaseous blow means being directed towards the pickup roll at a minimum angle.

Referring to FIG. 7 the spray pattern of the fluid being moved to the transfer roll is illustrated when the center line 21' of the gaseous blow means is inclined a minimum angle of 7° with respect to a chord A-B which subtends an arcuate angle of approximately 57° with respect to the pickup roll 16 and where the chord is approximately $\frac{7}{8}$ of the radius of the pickup roll from the center of the roll. It has been found that if the anglethat the gaseous center line of the blow means makes with respect to the chord is less than 7° some fluid will be blown from the fluid retaining means 23 directly onto the surface of the transfer roll without first impinging upon the surface of the pickp roll and rebounding again through the fluid retaining means towards the transfer roll.The effect is that this fluid impinges on the surface of the transfer roll in relatively large droplets resulting in uneven distribution of liquid on the transfer roll.

Figure 8:
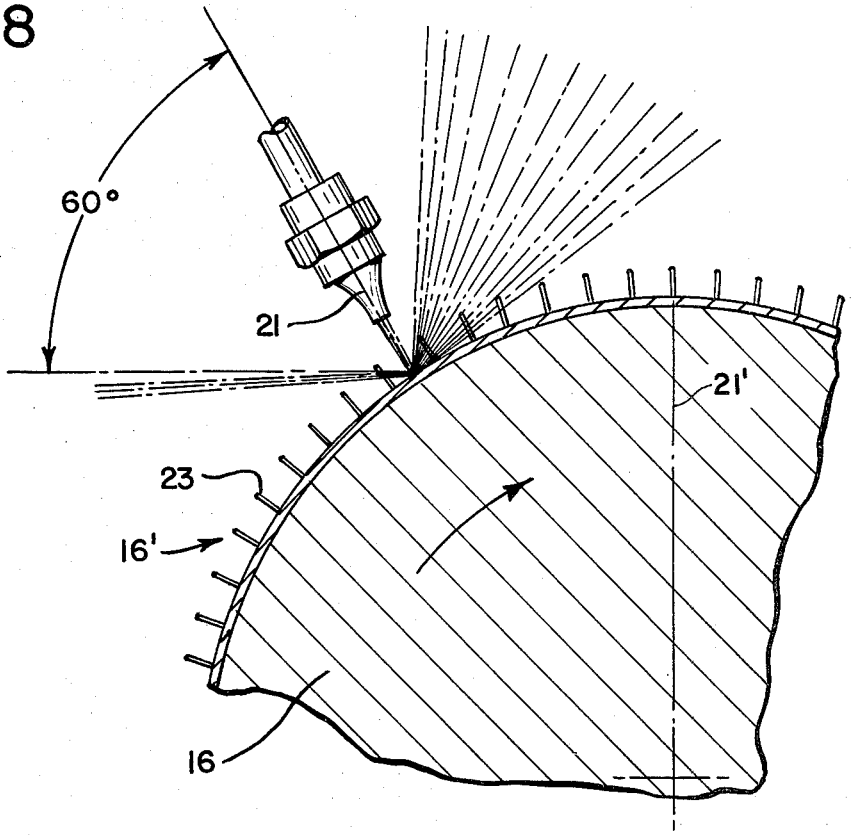
FIG. 8 is a view similar to FIG. 7 illustrating the spray pattern resulting from the gaseous blow means being directed towards the pickup roll at a maximum angle.

FIG. 8 illustrates the resulting spray pattern when the center line of the gaseous blow means is directed at the pickup roll at an extreme angle with respect to the chord A-B forexample 60°. In this event the resulting pattern of the spray towards the transfer roll is extremely wide and some spray will be directed away from the pickup roll on the opposite side from the transfer roll where it may contaminate other parts of the press. We have found that in practice the maximum effective angle to which the center line of thegaseous blow means may be inclined with respect to the chord A-B is on the order of 55°.

The degree of spread of the spray upon the pickup roll to the transfer roll may be effectively controlled by movement of the gaseous blow means with respect to the pickup roll where small angles of inclination of the center line will result in smaller spray patterns and large angles will result in larger spray patterns. Whether small or large spreads are to be used depends in part on positioning of the transfer roll with respect to the blow means.

The construction of a device as shown in FIG. 1 provides easy regulation of the amount of fluid to be transferred to a printing plate. For example, in the event that a greater amount of dampening fluid is desired to be transferred to the printing plate, the speed of the roll 16 is increased relative to the speeds of the rolls 15, 14, 13 and plate cylinder 10 whereby a greater amount of fluid is transferred. Conversely in the event that a lesser amount of fluid is to be transferred, the rate of rotation of the roll 16 may be decreased. A further regulation of the amount of fluid transferred may be obtained by varying the pressure in the gaseous blow means where an increase in pressure will result in a greater amount of fluid being transferred.

It has been found that the gap D or space between the rolls 15 and 16 should be comparatively small and no greater than about one-quarter inch. This gap prevents any back-feeding of emulsified ink from the plate cylinder to the fountain thus preventing pollution of the fluid in the fountain while at the same time assuring that the required atomized droplets of fluid rebounding from roll 16 will impinge onto the surface of roll 15 and be prevented from spreading over other areas of the press.

Further, the device according to the invention may be easily regulated to control the amount of dampening fluid applied longitudinally with respect to the plate cylinder. This may be accomplished by masking off certain of the orifices or nozzles in the duct 19 in the area in which it is not desired to print.

Figure 9:
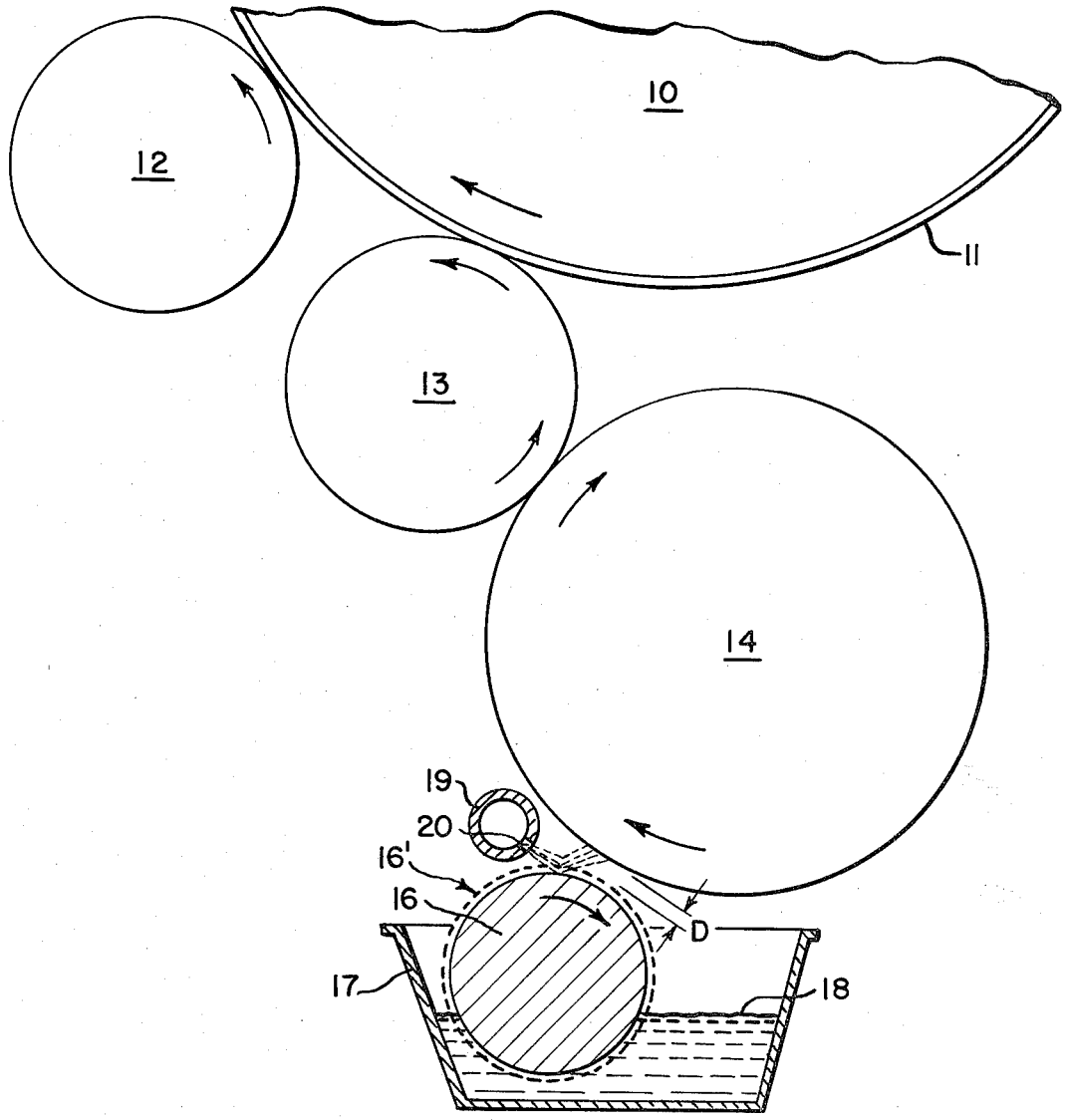
FIG. 9 is a view similar to FIG. 1, but where the fluid distribution means comprises a form roll.

Referring toFIG. 9, there is shown a further embodiment of the invention in which the spray from the pickup roll 16 impinges directly onto the drum 14. Because the spray pattern produced by the pickup roll-gaseous blow means combination of the invention is in the form of a fine mist due to the multiple breaking up of the fluid droplets, we have found that the use of a train of multiple drums and rolls as shown in FIG. 1 is not necessary to impart the thin fluid of film onto the plate cylinder and that the fluid distribution means may comprise a smaller train as shown in FIG. 9. In FIG. 9 the fluid distribution means comprises only a drum and form roll. Ideally the fluid distribution means may comprise only the form roll with the spray impinging directly onto the form roll without the necessity of including any additional transfer rolls or drums.

While as shown in FIGS. 1 and 9, the fluid is applied to the plate by a separate dampening fluid distribution system, the invention contemplates having the fluid sprayed on to part of an ink distribution system. In such event, ink would be applied to the form roll 13, through an ink distribution system comprising a separate train of rolls and drum contacting the form roll 13. Alternatively the dampening fluid could be applied to any of the rolls or drums incorporated into the ink distribution system using the pickup roll-gaseous blow means combination of the invention.

As seen, a device constructed according to our invention has a minimum of wearable parts as contrasted with devices using flicked brushes nor does it require any complicated electrical apparatus as do devices utilizing electrostatic forces. We have found that the use of a dampening device according to the invention results in a marked decrease in the amount of ink needed. It is believed that this is because a thinner film of dampening fluid is applied to the form roll and subsequently to the printing plate than with prior art dampening devices while at the same time maintaining even dampening or wetting over the entire plate surface.

We claim:

1. A dampening device for an offset lithographic printing machine of the type having a fluid fountain for containing a bath of dampening fluid, a pickup roll in said fountain adapted to extend into said bath, a plate cylinder carrying a printing plate, a rotatable fluid distribution means spaced from said pickup roll by a gap and disposed between said pickup roll and said printing cylinder and rotation means for rotating said pickup roll and said distribution means; the improvement comprising in that said pickup roll has a fluid retaining means thereon in the form of a fine wire mesh smooth cylindrical screen on the surface thereof with the wires of the screen comprising thread-like portions forming circumferentially evenly spaced openings where said openings are spaced uniformly radially outwardly from the peripheral surface of the pickup roll for picking up and retaining a thin film of fluid when said pickup roll is rotated in said bath, and in having gaseous blow means the center line of which is directed inwardly toward the peripheral surface of the pickup roll near said gap for breaking up said thin film into droplets and blowing said droplets onto the peripheral surface of the pickup roll where said droplets are atomized into smaller droplets and where said smaller droplets rebound from said surface to pass through said screen to be further atomized to form a fine mist and to move across said gap to the fluid distribution means.

2. A dampening device according to claim 1 wherein said center line is directed towards said pickup roll between an angle of 7°–55° with respect to a chord which subtends an arcuate angle of approximately 57° with respect to the pickup roll.

3. A dampening device according to claim 1 wherein said gap is less than one-quarter inch.

4. A dampening device according to claim 1 wherein said gaseous blow means comprises a gas duct having a plurality of nozzles therein extending parallel to the longitudinal axis of said pickup roll.

5. A dampening device according to claim 1 having in addition variable speed means for varying the speed of rotation of said pickup roll to vary the amount of fluid transferred to a printing plate.

6. A dampening device according to claim 1 having in addition means for varying the pressure of said gaseous blow means whereby the amount of fluid transferred to a printing plate may be varied.

7. A dampening device according to claim 1 wherein said fluid distribution means comprises a plurality of rotatable members positioned in a train with one of said members engaging said printing cylinder and said mist impinging against another of said rotatable members.

8. A dampening device according to claim 7 wherein said one of said rotatable members comprises a form roll and wherein said another of said rotatable members comprises a transfer roll.

9. A dampening device according to claim 7 wherein said one of said rotatable members comprises a form roll and wherein said another of said rotatable members comprises a drum.

* * * * *